US010120324B2

(12) United States Patent
Bacelieri et al.

(10) Patent No.: US 10,120,324 B2
(45) Date of Patent: Nov. 6, 2018

(54) LUBRICANT METERING FOR PHOTOCONDUCTOR IN IMAGING DEVICE

(71) Applicant: LEXMARK INTERNATIONAL, INC., Lexington, KY (US)

(72) Inventors: Michael Brian Bacelieri, Lexington, KY (US); Marc Cousoulis, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/371,411

(22) Filed: Dec. 7, 2016

(65) Prior Publication Data

US 2018/0157208 A1 Jun. 7, 2018

(51) Int. Cl.
*G03G 21/00* (2006.01)

(52) U.S. Cl.
CPC ..... *G03G 21/0094* (2013.01)

(58) Field of Classification Search
None
See application file for complete search history.

(56) References Cited

U.S. PATENT DOCUMENTS 4,435,074 A 3/1984 Midorikawa
4,757,349 A 7/1988 Toshimitsu
5,204,034 A 4/1993 Sasame
5,272,029 A 12/1993 Sakai
5,321,582 A 6/1994 Casperson
5,463,456 A 10/1995 Yashiki
5,589,924 A 12/1996 Yano
5,646,718 A 7/1997 Suwa
5,771,424 A 6/1998 Lindblad
6,060,205 A 5/2000 Takeichi
6,160,977 A 12/2000 Takeichi
6,295,437 B1 9/2001 Hodoshima
6,295,438 B1 9/2001 Fujishiro
6,330,420 B1 12/2001 Honda
6,611,671 B2 8/2003 Shoji
6,768,879 B2 7/2004 Kosuge
6,775,511 B2 8/2004 Kosuge
6,778,805 B2 8/2004 Kai
6,922,543 B2 7/2005 Kanagawa
6,983,120 B2 1/2006 Ishii
7,035,582 B2 4/2006 Suda
7,149,465 B2 12/2006 Amemiya
7,209,698 B2 4/2007 Tawada
7,209,699 B2 4/2007 Yamaguchi
(Continued)

*Primary Examiner* — Thomas Giampaolo, II

(57) ABSTRACT

An imaging device has a photoconductive drum with a surface that is selectively discharged to create a latent electrostatic image for attracting toner for transfer to a media moving in a process direction. The image is divided into multiple segments along the process direction and discharged pixels per segment are counted. An accumulator keeps track of the numbers of pixels per revolutions of a roller that applies the toner to the drum. Upon meeting a predetermined deficiency in the counts of pixels in any given segment, an artificial image gets generated on the surface of the photoconductive drum that supplies the missing pixels, per segment. The image gets developed with toner, but does not transfer to the media. Lubrication occurs on the surface of the drum and each segment retains a relatively common number of imaging pixels that get developed over time.

20 Claims, 2 Drawing Sheets

(56) References Cited

U.S. PATENT DOCUMENTS

| | | | |
|---|---|---|---|
| 7,302,197 | B2 | 11/2007 | Kosuge |
| 7,313,347 | B2 | 12/2007 | Shintani |
| 7,343,132 | B2 | 3/2008 | Kimura |
| 7,373,101 | B2 | 5/2008 | Hozumi |
| 7,376,380 | B2 | 5/2008 | Koike |
| 7,392,008 | B2 | 6/2008 | Takahashi |
| 7,430,377 | B2 | 9/2008 | Koike |
| 7,459,257 | B2 | 12/2008 | Shirodai |
| 7,480,473 | B2 | 1/2009 | Matsuura |
| 7,486,914 | B2 | 2/2009 | Kabata |
| 7,496,324 | B2 | 2/2009 | Sugiura |
| 7,496,343 | B2 | 2/2009 | Khorram |
| 7,505,728 | B2 | 3/2009 | Yamaguchi |
| 7,536,147 | B2 | 5/2009 | Kageyama |
| 7,542,712 | B2 | 6/2009 | Tanaka |
| 7,542,713 | B2 | 6/2009 | Yoshida |
| 7,583,925 | B2 | 9/2009 | Karasawa |
| 7,593,682 | B2 | 9/2009 | Tokumasau |
| 7,603,071 | B2 | 10/2009 | Sugiura |
| 7,616,922 | B2 | 11/2009 | Yoshino |
| 7,673,635 | B2 | 3/2010 | Hozumi |
| 7,680,446 | B2 | 3/2010 | Shintani |
| 7,691,791 | B2 | 4/2010 | Usami |
| 7,693,475 | B2 | 4/2010 | Shakuto |
| 7,702,257 | B2 | 4/2010 | Kosuge |
| 7,706,735 | B2 | 4/2010 | Kishi |
| 7,715,750 | B2 | 5/2010 | Kagawa |
| 7,725,069 | B2 | 5/2010 | Kawahara |
| 7,756,447 | B2 | 7/2010 | Kosuge |
| 7,826,786 | B2 | 11/2010 | Suda |
| 7,831,189 | B2 | 11/2010 | Harada |
| 2009/0297184 | A1* | 12/2009 | Kubo ..... G01N 27/121 399/44 |
| 2011/0200340 | A1* | 8/2011 | Kojima ..... G03G 15/0856 399/12 |
| 2014/0241739 | A1* | 8/2014 | Takeuchi ..... G03G 15/556 399/27 |
| 2014/0340457 | A1* | 11/2014 | Hashimoto ..... G03G 21/0011 347/118 |

* cited by examiner

LUBRICANT METERING FOR PHOTOCONDUCTOR IN IMAGING DEVICE

FIELD OF THE INVENTION

The present disclosure relates to the application of lubricant on a photoconductive (PC) drum in an imaging device. It relates further to apportioning the lubricant on the PC drum over a lifetime.

BACKGROUND

Photoconductive (PC) drums have long been used in electrophotographic (EP) processes for transferring imaging data. They have a surface that gets charged to a uniform potential by a charge roller/corona/etc. and selectively discharged to create a latent electrostatic image for development with toner for transfer to media. They are installed as replaceable components of imaging devices, e.g., laser printers, copiers, fax machines, multifunction devices, etc. They come packaged as stand-alone units or as parts of toner cartridges. Manufacturers continually design them to decrease their wear rates and improve longevity. Certain embodiments add a lubricant. An applicator brush scrapes the lubricant and transfers it to a drum surface at a transfer nip during rotation of both the brush and the drum. An elongate rod contacts the brush to flicker away any residual particles stuck to the brush. A cleaning blade also scrapes clean the surface of the drum.

As has been noticed by the inventors, however, the lubricant builds up over time on the drum surface in locations that become less frequently developed with toner. Such has been found to cause variations of charge resistivity at the drum surface and noted to introduce particulate contamination in EP components or the toner. Problems in printed media have even been observed in the form of streaks or mottled defects.

SUMMARY

The foregoing and other are solved by a lubricant metering process for a photoconductive drum over a lifetime of the drum. In one embodiment, an imaging device has a PC drum with a surface that is selectively discharged to create a latent electrostatic image for attracting toner for transfer to a media moving in a process direction. The image is divided into multiple segments along the process direction and discharged pixels per segment are counted. An accumulator keeps track of the numbers of pixels per revolutions of a roller that applies the toner to the drum. Upon meeting a predetermined deficiency in the counts of pixels in any given segment, an artificial or ersatz image gets generated on the surface of the photoconductive drum that supplies the missing pixels, per segment. The image gets developed with toner, but does not transfer to the media. Lubrication occurs on the surface of the drum and each segment retains a relatively common number of imaging pixels that get developed over time. The technique has been seen to minimize the contamination of EP components and toner. Embodiments contemplate segmentation, roller revolutions, sufficiency of pixel counts, arrangement of components, and environmental conditions for use.

In other embodiments, an imaging device receives imaging data from an external computer, mobile device, laptop, etc. or from an attendant scanner, fax machine or memory. The imaging data includes one or more images. Each image gets divided into eight or more segments of equal width in the process direction of media travel. A controller counts the pixels per image per segment while an accumulator tallies the count from one image to the next. The toner is magnetic and a magnetic roller supplies the toner for adhesion to a surface of the PC drum, per each C, M, Y, K color plane. That the arrangement of the PC drum is quite large relative to the magnetic roller, the drum rotates about 2.5 times per an image for transfer to a standard media having letter size (8.5"×11"), while the magnetic roller revolves about eight to nine times. Adjusting for this revolution, the number of imaged pixels per segment is divided by the number of revolutions of the magnetic roller per image. This adjustment of pixels is subtracted from a predetermined average magnetic roller revolution per imaged pixel, in this instance 15,000 pixels/magnetic roller revolution. If one or more of the eight (+) segments are not being imaged relatively frequently, the value stored in the accumulator per that segment grows more and more negative. Once the accumulator hits a predetermined negative threshold, an artificial image is generated that produces the required pixels for that segment. Lubricant is applied and the surface of the PC drum has relatively common numbers of pixels imaged per segment over the lifetime of the drum. These and other embodiments are described below.

DETAILED DESCRIPTION OF THE ILLUSTRATED EMBODIMENTS

Figure 1:
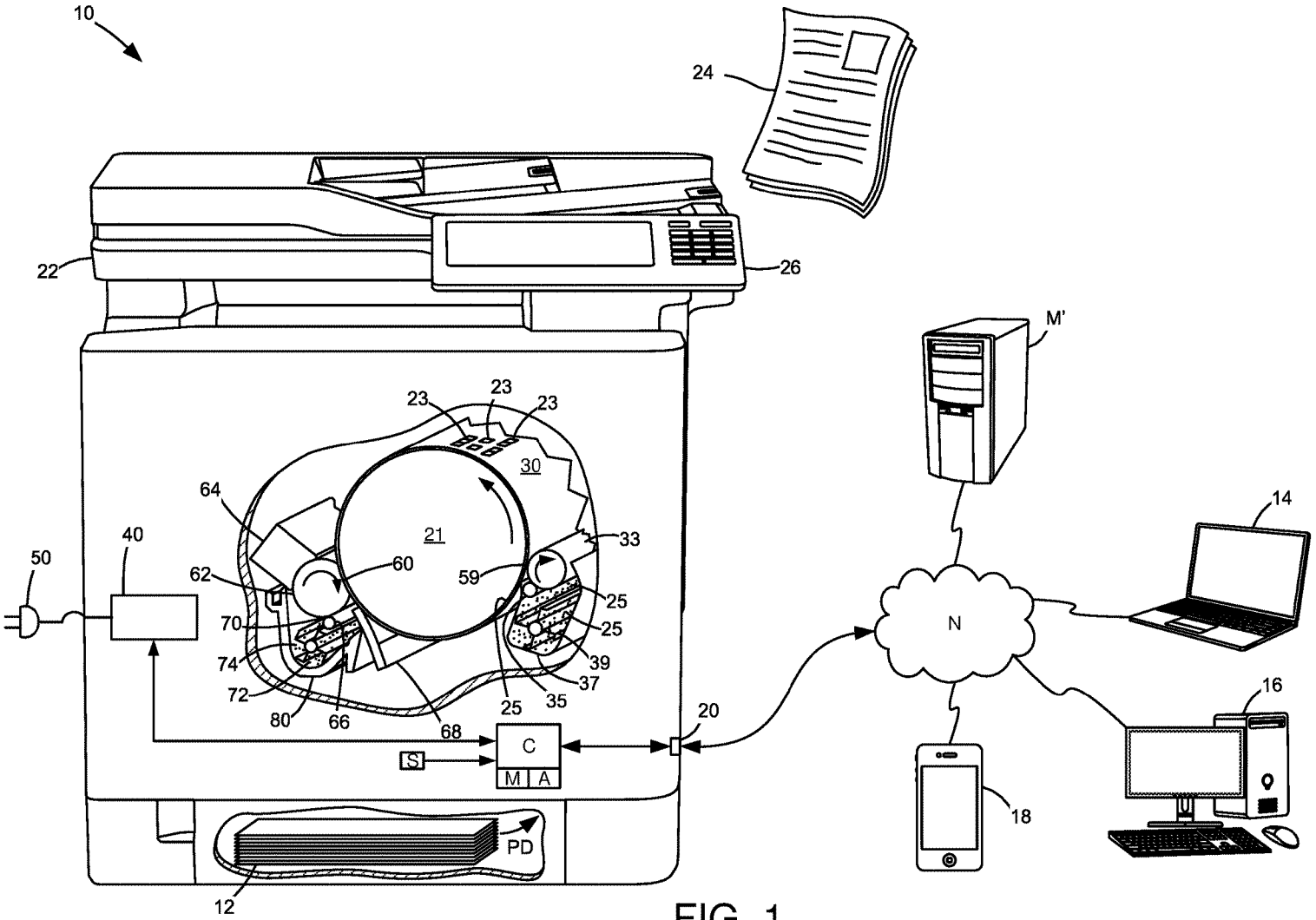
FIG. 1 is a diagrammatic view of an imaging device, including cutaway with exaggerated partial diagrammatic view of a photoconductive drum, lubricant, applicator brush, toner application roller and toner supply.

With reference to FIG. 1, an imaging device 10 images media 12, as is familiar. Imaging data for the media arrives from external sources, such as a laptop 14, computer 16, mobile device 18, etc. The sources connect direct to the imaging device at communications port 20 or indirect by way of a computing network (N). Alternatively, the imaging data arrives by way of an attendant scanner 22 that scans media 24 having data thereon, an integrated fax machine 26, or from local (M) or remote memory (M'), such as on a print server, accessible by a controller (C), such as an ASIC(s), circuit(s), microprocessor(s), etc. Upon receipt, the controller causes the imaging data to be converted to printed data on the sheet(s) of media.

Hardware of the imaging device includes a photoconductive (PC) drum 21 having a core 25 upon which one or more layers are fashioned to create a photosensitive drum surface 30. The surface is biased to a voltage potential during use through rollers, coronas, or the like (not shown). The voltages come from connection to a high voltage power supply 40, in turn connected to an external power source at 50. The controller C regulates their application. A laser or other light source (not shown) selectively discharges pixels 23 of the image data on the surface of the PC drum to create a latent electrostatic image on the PC drum. Particles of toner 25 become attracted to the discharged pixels and such transfers to the media and fused for hard copy output. The toner gets applied to the drum surface 30 by way of an application roller 33 at a toner transfer nip 59. The drum and roller revolve in the direction of their action arrows.

In a further embodiment, the toner is magnetic and the roller 33 is a magnetic roller that attracts the toner through magnetic attraction. A trim bar 35 levels a height of the toner attracted to the roller 33 before application to the PC drum. The toner resides in a hopper 37 of a replaceable toner cartridge that may contain an auger 39 to move the toner into a position for attraction to the roller.

At a transfer nip 60, lubricant 64 is applied to the surface of the drum to extend its life and minimize its wear rate. The lubricant is any of a variety, but zinc stearate has been found to work well. The lubricant is formed as a rectangular block having a length comparable to an axial length of the surface 30 of the drum and is sufficiently lengthy to lubricate an entire surface of the drum that can be developed with toner. The lubricant is biased into contact with an applicator brush 62 that similarly extends along the axial length of the drum. The brush 62 and drum 21 rotate in the direction of their action arrows and, as the brush rotates, bristles of the brush scrub off flakes of the lubricant which remain situated on the bristles. At the transfer nip 60, the flakes transfer off the bristles and onto the surface of the drum. As the applicator brush continues to rotate, it contacts an elongate rod 66 at nip 70 to flicker off any lubricant remaining on the brush or undeveloped toner particles that attached to the brush at the transfer nip. A cleaning blade 68 scrapes clean the surface of the PC drum. The lubricant flakes 72 and toner remnants 74 collect in a sump of a bin 80 for disposal. An auger 76 can rotate to move out the collected particles.

To minimize contamination of EP components and toner with the lubricant, a process algorithm for execution by the controller includes dividing the imaging data into multiple segments along the process direction (PD) of media travel and discharged pixels per segment are counted. An accumulator (A) keeps track of the counts and, upon meeting a predetermined deficiency in the count of pixels in any given segment, an artificial image gets generated on the surface of the photoconductive drum that supplies the missing pixels, per segment. The artificial image gets developed with toner, but does not transfer to media. Upon lubrication, each segment of the PC drum retains a relatively common number of imaging pixels that get developed over time and the problems of the prior art are avoided. In one embodiment, this simply means determining whether or not a sufficient number of imaging pixels exist at predetermined locations in the image; and if not, developing an artificial image on the surface of the drum having the sufficient number of pixels at the predetermined locations.

Figure 2:
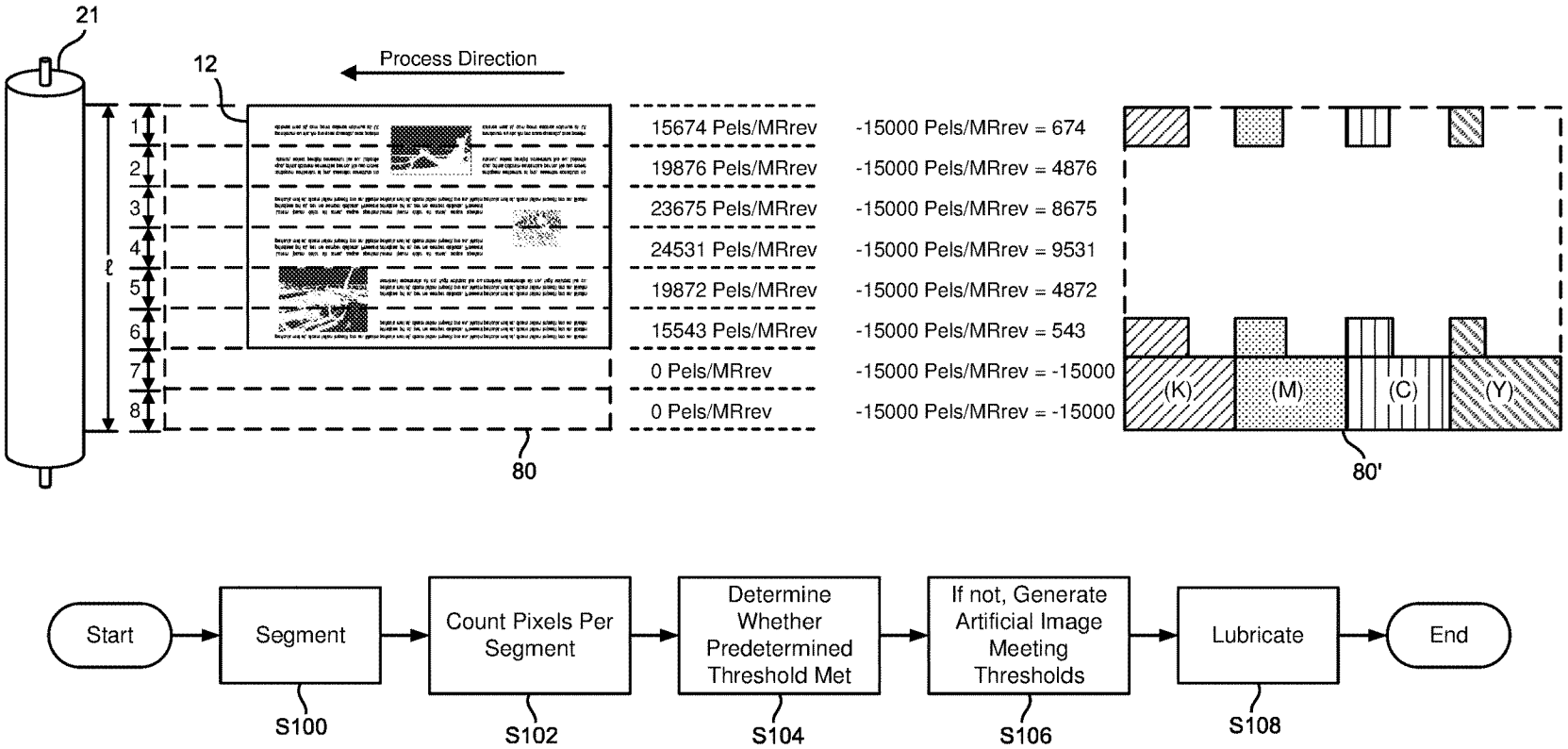
FIG. 2 is a diagrammatic and processing view of a scheme to meter lubricant to the PC drum over its lifetime.

With reference to FIG. 2, a more specific implementation includes dividing into width segments the full imaging data 80 for transfer to a media 12. The segments correspond to the length (1) of the surface of the PC drum 21 that remain available for discharging during imaging operations. The image segments exist along the process direction in which the media travels in the imaging device and includes eight (or more) segments of equal widths, labeled 1-8.

At S102, pixels are counted per each of the segments. That is, each of the pixels of the imaging data to-be-discharged on the surface of the drum are counted in each of the segments. In this example, the pixel counts per segment are: 15,674 pixels (pels) in segment 1; 19,876 pixels in segment 2; 23,675 pixels in segment 3; 24,531 pixels in segment 4; 19,872 pixels in segment 5; 15,543 pixels in segment 6; 0 pixels in segment 7; and 0 pixels in segment 8. As will be noticed, there is uneven distribution of pixels per segment. Some segments have a great number of pixels being imaged (segments 1-6), and thence developed with toner, whereas other segments have no pixels being imaged (segments 7 and 8). This results in an uneven distribution of use on the surface of the PC drum. In turn, applying lubricant to the drum results in the problems noted earlier. (The count of pixels per segment can be also normalized to revolutions of the roller that applies toner to the PC drum. In one embodiment, this means normalizing the count of pixels per segment versus revolutions of the magnetic roller (MRrev), which revolves about eight to nine times per 2.5 revolutions of the PC drum when imaging a standard media of 8.5"×11".)

At S104, the counts of pixels are measured against predetermined thresholds to see if a sufficient number of pixels are being imaged per segment. Continuing the earlier example, each segment is evaluated as to whether 15,000 pixels have been imaged with their differences being noted per segment, e.g.: +674 pixels per segment 1; +4876 pixels per segment 2; +8675 pixels per segment 3; +9531 pixels per segment 4; +4872 pixels per segment 5; +543 pixels per segment 6; and −15,000 pixels per of segments 7 and 8. (This step can be also normalized versus the revolutions of the magnetic roller (MRrev) in the event the pixel counts are normalized.) In the event sufficient pixels are not being imaged per any of the segments (S106), an artificial or dummy image 80' is generated that meets the minimum number of thresholds, per segment, per color plane (C), (M), (Y) and (K). In this example, there exists zero pixels being imaged in segments 7 and 8 in image 80, thus the artificial image 80' includes multiple pixels being imaged for these segments thereby overcoming the deficiency. That segments 1 and 6 also have relatively fewer pixels being imaged versus segments 2-5, the artificial image 80' supplies additional pixels for imaging, per color, but not as many as segments 7 and 8. Thence lubrication occurs at S108 and all segments have relatively the same numbers of pixels being imaged and lubricated per segment. Over the lifetime of the PC drum, this ensures relatively common wear on the surface of the drum, thus avoiding uneven distribution of lubricant. Of course, other schemes are possible.

For instance, the assessment of whether segments meet predetermined thresholds can be iterative determinations from one image to a next image until some aggregated deficiency of pixels is noted. Alternatively still, the lubricant scheme might be deferred until after some minimum number of media have been printed by the imaging device, say 40,000 sheets of media. The lubricant processing may be also bifurcated amongst color images and black-only images. Still further, the inventors have contemplated only executing the scheme upon reaching a predetermined atmospheric dryness condition of the environment in which the PC drum is operated. This includes measuring the dryness with a sensor (S) (FIG. 1) and providing that to the controller. Upon the environment being 22 ABS grains of moisture or drier, the controller then initiates the lubricant metering routine The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. In an imaging device having a photoconductive drum with a surface that is selectively discharged to create a latent electrostatic image for attracting toner for transfer to a media moving in a process direction and a lubricant other than the toner for application to the surface of the photoconductive drum, wherein the toner is applied to the surface of the photoconductive drum by a roller, a method comprising:

determining whether a sufficient number of imaging pixels exist at predetermined locations in said image;

if not, generating another image on the surface of the photoconductive drum having a number of pixels meeting the sufficient number of pixels at the predetermined locations, said number of pixels being developed with the toner but not transferred to said media; and lubricating the surface of the photoconductive drum with the lubricant after said number of pixels are developed with the toner.

2. The method of claim 1, further including lubricating the surface of the photoconductive drum with zinc stearate applied to an applicator brush in contact with the photoconductive drum.

3. The method of claim 1, further including counting a number of revolutions of the roller.

4. The method of claim 1, further including counting pixels per every image on the surface of the photoconductive drum.

5. The method of claim 1, further including segmenting the predetermined locations into equal widths along the process direction.

6. The method of claim 5, further including segmenting the predetermined locations into eight equal widths.

7. The method of claim 1, further including counting pixels per every image on the surface of the photoconductive drum per every revolution of the roller.

8. In an imaging device having a photoconductive drum with a surface that is selectively discharged to create a latent electrostatic image for attracting toner for transfer to a media moving in a process direction and a lubricant other than the toner for application to the surface of the photoconductive drum, the toner being applied to the surface by way of a roller, a method comprising:

receiving imaging data for the image, the imaging data having pluralities of imaging pixels;

dividing the image into segments in the process direction;

counting how many of the imaging pixels exist in said image per each of the segments;

determining whether a deficiency exists in the counted imaging pixels per said each of the segments;

if the deficiency exists in any one or more of the segments, generating another image on the surface of the photoconductive drum having a number of imaging pixels overcoming the deficiency;

developing with the toner the number of imaging pixels per said any one or more of the segments, but not transferring the toner to the media; and lubricating the surface of the photoconductive drum with the lubricant.

9. The method of claim 8, further including dividing the image into eight segments of equal width.

10. The method of claim 8, further including counting a number of revolutions of the roller.

11. The method of claim 10, further including normalizing the counted imaging pixels per the number of revolutions of the roller.

12. The method of claim 8, further including accumulating a count of pixels per said each of the segments for every image on the surface of the photoconductive drum.

13. The method of claim 8, further including determining an atmospheric dryness in which the photoconductive drum is operated.

14. The method of claim 8, wherein if the deficiency does not exist in said any one or more of the segments, accumulating a count of pixels of a next image developed on the photoconductive drum and determining again whether or not the deficiency exists in the counted imaging pixels per said each of the segments.

15. The method of claim 8, further including scraping the toner from the surface of the photoconductive drum.

16. The method of claim 8, further including scraping the lubricant from the surface of the photoconductive drum.

17. In an imaging device having a photoconductive drum with a surface that is selectively discharged to create a latent electrostatic image for attracting toner for transfer to a media moving in a process direction and a lubricant other than the toner for application to the surface of the photoconductive drum, the toner being applied to the surface by way of a roller in contact with the surface of the photoconductive drum, the lubricant being applied to the surface of the photoconductive drum by way of an applicator brush in rolling contact with the photoconductive drum, a method comprising:

receiving imaging data for the image, the imaging data having pluralities of imaging pixels;

accumulating a count of the imaging pixels from said image to a next image;

determining when said count of the imaging pixels does not meet a minimum number of imaging pixels for any segment along the process direction;

generating another image on the surface of the photoconductive drum having a number of imaging pixels meeting the minimum number of pixels for said any segment for developing with the toner but not transferring to the media; and lubricating the surface of the photoconductive drum with the lubricant after the development with the toner of said another image.

18. The method of claim 17, further including dividing the image into eight segments of equal width along the process direction.

19. The method of claim 17, further including lubricating the surface of the photoconductive drum with zinc stearate applied to bristles of the applicator brush.

20. The method of claim 17, further including determining an atmospheric dryness in which the photoconductive drum is operated.

* * * * *